US006929483B2

(12) United States Patent
Huang et al.

(10) Patent No.: US 6,929,483 B2
(45) Date of Patent: Aug. 16, 2005

(54) ELECTRICAL CONTACT HAVING CONTACT PORTION WITH ENHANCED RESILIENCY

(75) Inventors: Chih-Rung Huang, Tu-chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/463,791

(22) Filed: Jun. 16, 2003

(65) Prior Publication Data

US 2004/0077190 A1 Apr. 22, 2004

(30) Foreign Application Priority Data

Oct. 18, 2002 (TW) ..... 91216624 U

(51) Int. Cl.[7] ..... H01R 9/09
(52) U.S. Cl. ..... 439/66; 439/862
(58) Field of Search ..... 439/66, 74, 83, 439/862, 876

(56) References Cited

U.S. PATENT DOCUMENTS 4,995,819 A * 2/1991 Ohl ..... 439/79
5,100,338 A * 3/1992 Lu ..... 439/326
5,518,426 A * 5/1996 Plainer ..... 439/682
5,586,890 A * 12/1996 Braun ..... 439/66
6,210,176 B1 4/2001 Hsiao
6,241,531 B1 * 6/2001 Roath et al. ..... 439/66
6,454,588 B1 * 9/2002 Pickles et al. ..... 439/862
6,478,600 B1 * 11/2002 Wang et al. ..... 439/862
6,652,329 B1 * 11/2003 Howell et al. ..... 439/862

* cited by examiner

*Primary Examiner*—Renee Luebke
(74) *Attorney, Agent, or Firm*—Wei Te Chung

(57) ABSTRACT

An electrical contact (1) includes a retention portion (10) and a cantilever (12) extending upwardly from the retention portion. The cantilever includes a first extending portion (121) and a second extending portion (120) bent vertically from the first extending portion. A top elevation projection of the second extending portion relative to the retention portion forms an acute angle therebetween. The first and second extending portions are both resiliently deformable. Thus the contact attains good resilient characteristics. Moreover, a contact strip (16) for the contact comprises an elongate carrier strip (160) and a plurality of strip contacts (1') attached to the carrier strip. Each strip contact includes a cantilever (12') having a second extending portion (120'). The second extending portion is orientated at an acute angle relative to a longitudinal axis of the carrier strip. Thus gaps between two adjacent strip contacts are small, which reduces production costs of the contact.

13 Claims, 5 Drawing Sheets

ELECTRICAL CONTACT HAVING CONTACT PORTION WITH ENHANCED RESILIENCY

BACKGROUND OF THE INVENTION

1. Field of the Invention

The present invention relates to an electrical contact, and more particularly to an electrical connector contact for electrical interconnecting two electrical interfaces such as contact pads of an integrated circuit (IC) package and a printed circuit board (PCB).

2. Description of the Prior Art

There are two current trends in the connector industry that pose great challenges for manufacturers: the trend toward miniaturization of socket connectors, and the trend toward increased density of arrays of electrical contacts in the socket connectors. In a typical miniaturized socket connector, each contact received in a housing of the socket connector is short and occupies only a limited space. Thus a spring arm of the contact may be too short to provide good resilient characteristics. Consequently, engagement between the contacts of the socket connector and an associated electrical device may be unreliable.

In order to overcome the above problems, Taiwan Patent Issue No. 444960 discloses a socket connector. Referring to FIGS. 6, 7 and 8, the connector comprises a base 8 defining a plurality of passageways 80 arranged in a rectangular array having several rows and columns, and a corresponding number of contacts 9 received in the passageways 80. Each contact 9 defines a long elastic arm 92 and an engaging portion 91. Each passageway 80 includes two aligned slots 82 for engagingly receiving the engaging portion 91 of a corresponding contact 9. The slots 82 of diagonally adjacent passageways 80 are all aligned with each other, and cooperatively define a line oriented at an acute angle relative to the rows and columns of the array. The acute angle is typically 45 degrees. When the contacts 9 are received in the passageways 80, the arms 92 of the contacts 9 are each oriented at an angle of 45 degrees relative to the rows and columns of the array. This configuration enables each passageway 80 to be relatively long, thereby providing sufficient space to receive the long elastic arm 92 of the corresponding contact 9.

However, in assembly, a line of the contacts 9 is simultaneously inserted into a corresponding line of diagonally adjacent passageways 80, with the contacts 9 being detachably joined together by a common carrier strip in order to effect such simultaneous insertion. This procedure is repeated for each line of diagonally adjacent passageways 80. That is, firstly one contact 9 is inserted in a corner passageway 80 of the base 8 from a first carrier strip. Secondly, two contacts 9 are inserted in two diagonally adjacent passageways 80 from a second carrier strip. Thirdly, three contacts 9 are inserted three diagonally adjacent passageways 80 from a third carrier strip, and so on. The first, second, third and other carrier strips all have different lengths, and carry different numbers of the contacts 9. This makes manufacturing of the carrier strips unduly complicated, and also makes the procedure for inserting the contacts 9 unduly complicated.

FIG. 9 shows a conventional contact 60 comprising a retention portion 61, a soldering portion 64 bent perpendicularly from one end of the retention portion 61, and an engaging portion 63 extending from an opposite end of the retention portion 61. The engaging portion 63 has a curved configuration substantially perpendicular to the soldering portion 64. Thus the engaging portion 63 is relatively long, and gives the contact 60 good resilient characteristics.

Referring to FIG. 10, a corresponding contact strip 70 for the contacts 60 comprises an elongate carrier strip 66, a plurality of strip contacts 60', and a plurality of connecting portions 65 interconnecting the strip contacts 60' with the carrier strip 66. An engaging portion 63' of each strip contact 60' is relatively long, with the engaging portions 63' of the strip contacts 60' being aligned parallel to a longitudinal axis of the contact strip 70. Thus gaps between adjacent strip contacts 60' are relatively large. When the contact strip 70 is formed from sheet metal, there is considerable wastage of material, which increases manufacturing costs.

An improved electrical contact that overcomes the above problems is desired. A copending application with a Ser. No. 10/166,890, now U.S. Pat. No. 6,652,329 having the same assignee with the instant application, discloses some approach.

SUMMARY OF THE INVENTION

Accordingly, a main object of the present invention is to provide an electrical contact having both good resilient characteristics and low manufacturing costs.

To fulfill the above-mentioned object, an electrical contact comprises a retention portion, a connecting portion extending downwardly from a bottom of the retention portion, and a cantilever extending upwardly from a top of the retention portion. The cantilever includes a first extending portion, a second extending portion bent from a top of the first extending portion. From a side elevation aspect, the second extending portion is bent substantially perpendicularly from the top of the first extending portion. A top elevation projection of the second extending portion relative to the retention portion forms an acute angle therebetween. The first and second extending portions have a junction line therebetween, the junction line being parallel to the retention portion. This enables the second extending portion to be relatively long. Moreover, in use, the first and second extending portions both resiliently deform. Therefore, good resilient characteristics of the contact are attained.

Additionally, a contact strip for the contact comprise an elongate carrier strip, a plurality of linking portions extending from a longitudinal side of the carrier strip; and a plurality of strip contacts attached to the carrier strip by the linking portions. Each strip contact comprises a retention portion, a connecting portion extending from a rear of the retention, and a cantilever extending from a front of the retention. The cantilever comprising a first extending portion, and a second extending portion extending from a front of the first extending portion. The retention portion and the first extending portion have a central line that is perpendicular to a longitudinal axis of the carrier strip, and the second extending portion is orientated at an acute angle relative to the longitudinal axis of the carrier strip. Thus gaps between two adjacent strip contacts are small. As a result, the contact strip can be formed from sheet metal with minimal wastage of material, thereby reducing production costs.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
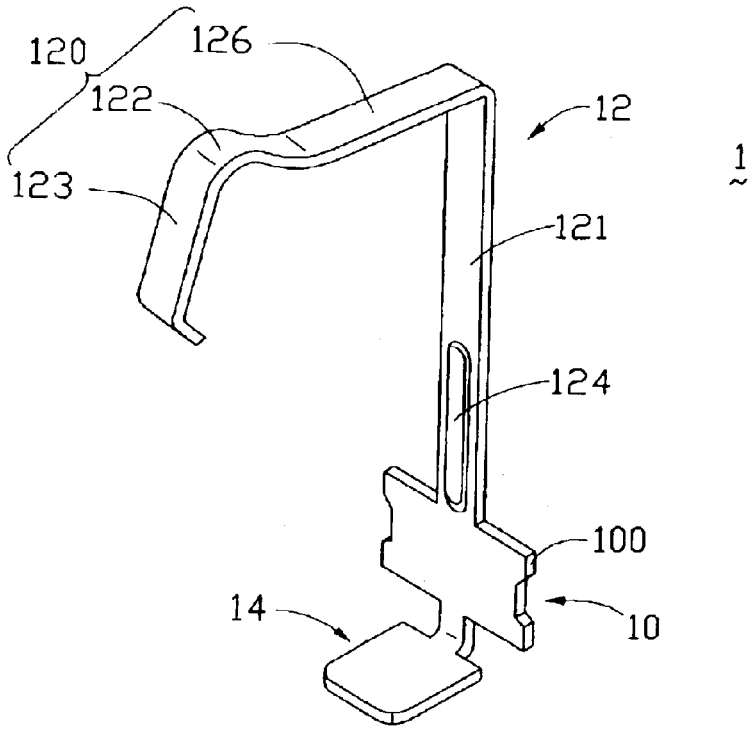
FIG. 1 is an isometric view of an electrical contact according to the present invention.
Figure 3:
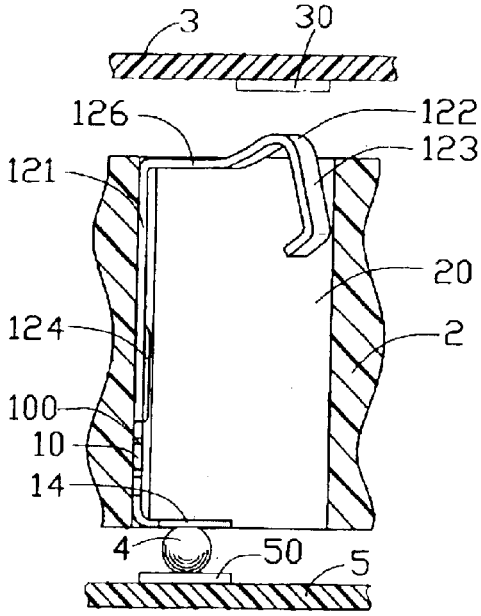
FIG. 3 is a schematic cross-sectional view corresponding to line III—III of FIG. 2, showing one of the contacts received in a corresponding passage of the housing; and showing a solder ball attached to a bottom of the contact, part of a PCB in cross-section connected with the solder ball, and part of an IC package in cross-section ready to be connected to a top of the contact.

Referring to FIGS. 1 and 3, an electrical contact 1 according to the present invention is for electrically interconnecting two electrical interfaces such as contact pads 50, 30 of a PCB 5 and a land grid array (LGA) package 3 respectively. The contact 1 comprises a vertical planar retention portion 10, a connecting portion 14 extending downwardly from a bottom of the retention portion 10, and a resilient cantilever 12 extending upwardly from a top of the retention portion 10.

A pair of barbs 100 is formed on each of opposite lateral side edges of the retention portion 10. The connecting portion 14 is substantially perpendicularly bent from the bottom of the retention portion 10, for electrically engaging a corresponding contact pad 50 on the PCB 5 via a soldering ball 4.

Figure 2:
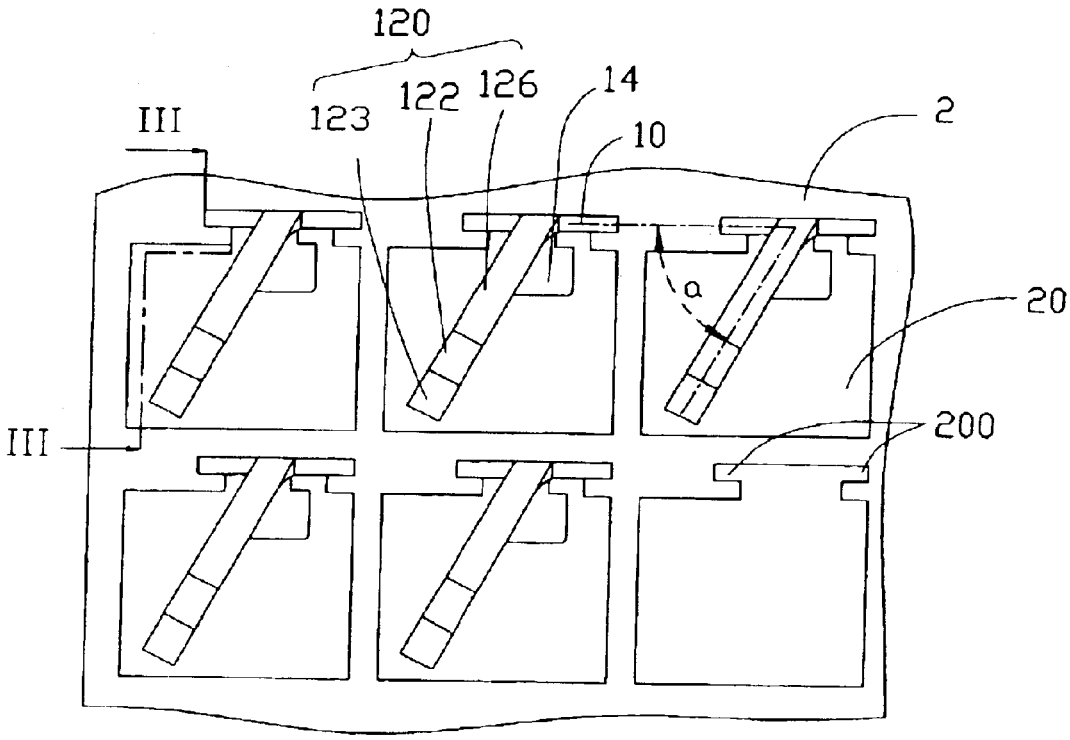
FIG. 2 is a top elevation view of part of a housing of an electrical connector, showing a plurality of contacts of FIG. 1 received in passages of the housing.

Referring also to FIG. 2, the cantilever 12 includes a vertical first extending portion 121 extending upwardly from the top of the retention portion 10, and a substantially horizontal second extending portion 120 bent from a top end of the first extending portion 121. A rib 124 is formed on the first extending portion 121, for enhancing a rigidity of the first extending portion 121. From a side elevation aspect, the second extending portion 120 is bent substantially perpendicularly from the topmost end of the first extending portion 121. A top elevation projection of the second extending portion 120 relative to the retention portion 10 forms an acute angle "a" therebetween. Further, the first and second extending portions 121, 120 define a junction line therebetween, the junction line being parallel to the retention portion 10.

The second extending portion 120 comprises a bent portion 126, a locating portion 123, and an engaging portion 122 interconnecting the bent portion 126 with the locating portion 123. The bent portion 126 adjoins the topmost end of the first extending portion 121. The engaging portion 122 is located at a topmost portion of the second extending portion 120, for electrically engaging with a corresponding contact pad 30 of the LGA package 3. The locating portion 123 extends obliquely downwardly from the engaging portion 122.

FIG. 2 shows part of a dielectric housing 2 of a socket connector in which a plurality of the contacts 1 is received. The housing 2 defines a plurality of passages 20 arranged in a rectangular array of rows and columns, the passages 20 respectively receiving the contacts 1 therein. A pair of aligned receiving slots 200 is defined in the housing 2 at each passage 20, for securing the retention portion 10 of a corresponding contact 1 therein. The slots 200 of the passages 20 in any one row of the passages 20 are all in alignment with each other. With this configuration, a row of the contacts 1 can be inserted into a corresponding row of the passages 20 at one time. Thus an efficiency of assembly of the socket connector is enhanced.

Additionally, as described above, the top elevation projection of the second extending portion 120 relative to the retention portion 10 of each contact 1 forms the angle "a" therebetween. Therefore, once the contact 1 is received in the corresponding passage 20, the second extending portion 120 is situated substantially along a diagonal of the passage 20. This enables the second extending portion 120 to be relatively long, thereby giving the contact 1 good resilient characteristics.

Figure 4:
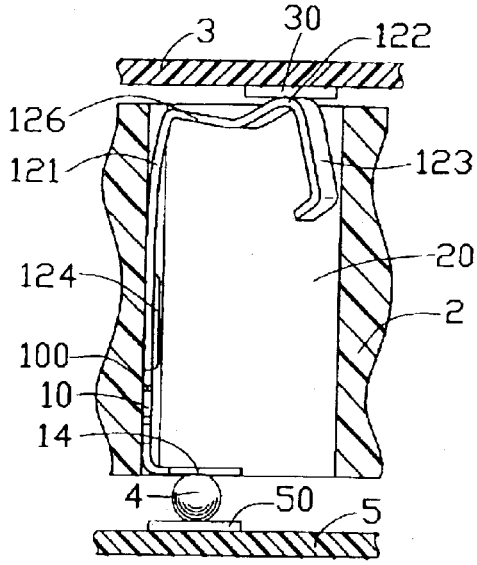
FIG. 4 is similar to FIG. 3, but showing the IC package connected to the top of the contact.

Referring to FIG. 4, in use, the connecting portions 14 of the contacts 1 are connected with the corresponding contact pads 50 of the PCB 5 via the soldering balls 4. The IC package 3 is engaged on the housing 2, and each contact pad 30 presses on the engaging portion 122 of the corresponding contact 1. The bent portion 126 and the first extending portion 121 of the contact 1 both resiliently deform, thereby giving the contact 1 good resilient characteristics. Said resilient deformation provides ample resilient force to assure firm mechanical and electrical engagement between the engaging portion 122 and the contact pad 30. Additionally, the locating portion 123 of the contact 1 ensures that the second extending portion 120 remains within the passage 20 of the housing 2 during said resilient deformation. Furthermore, the rib 124 prevents the first extending portion 121 from flexing too much. As a result, reliable mechanical and electrical engagement between the engaging portion 122 and the contact pad 30 is attained.

Figure 5:
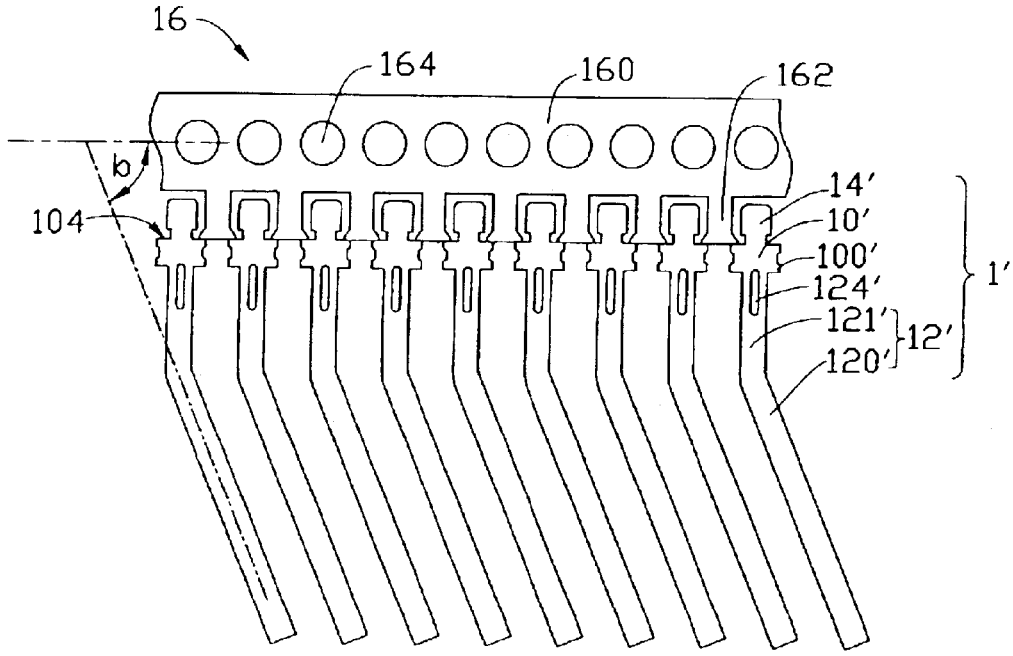
FIG. 5 is a top elevation view of part of a contact strip, the contact strip comprising a plurality of precursors of a plurality of the contacts of FIG. 1.
Figure 6:
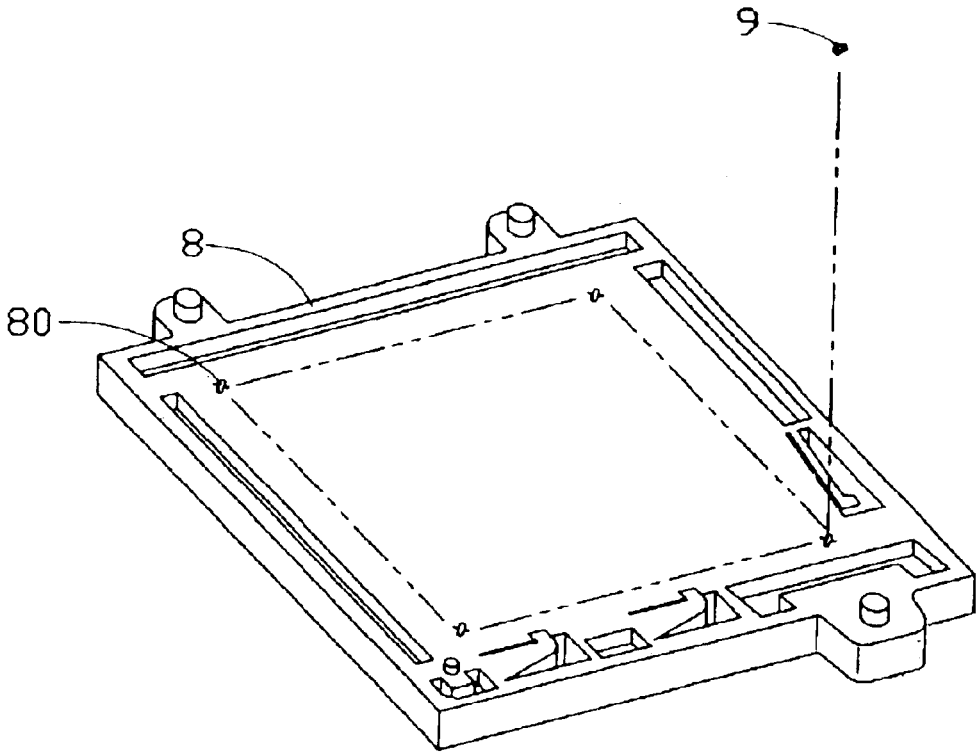
FIG. 6 (PRIOR ART)
FIG. 6 is a simplified, exploded isometric view of a conventional socket connector.
Figure 7:
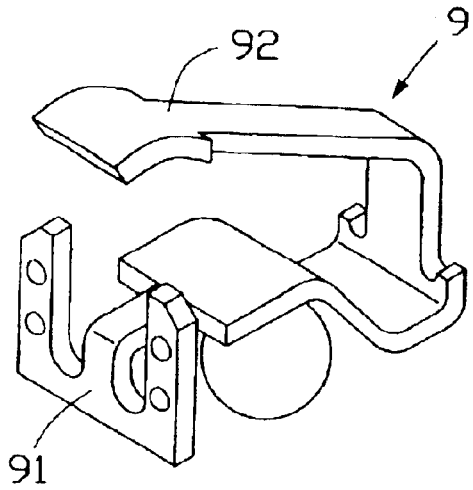
FIG. 7 (PRIOR ART)
FIG. 7 is an enlarged view of a contact of the socket connector of FIG. 6.
Figure 8:
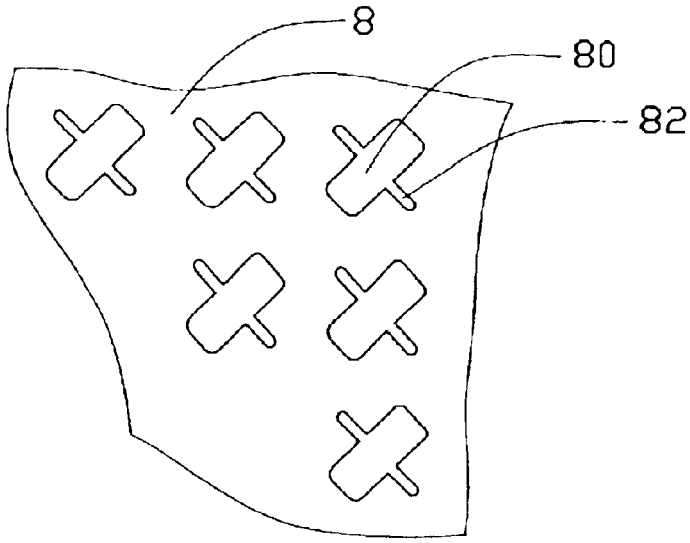
FIG. 8 (PRIOR ART)
FIG. 8 is a top elevation view of part of a housing of the socket connector of FIG. 6.
Figure 9:
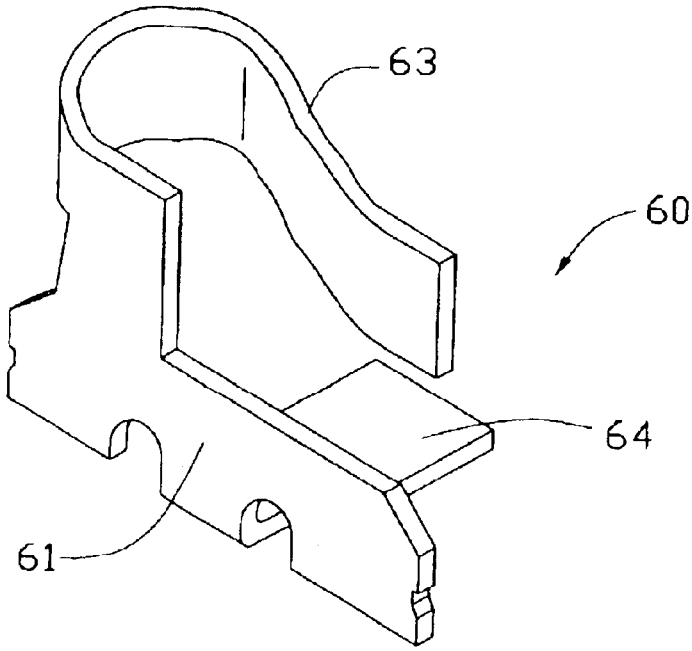
FIG. 9 (PRIOR ART)
FIG. 9 is an isometric view of a conventional electrical contact.
Figure 10:
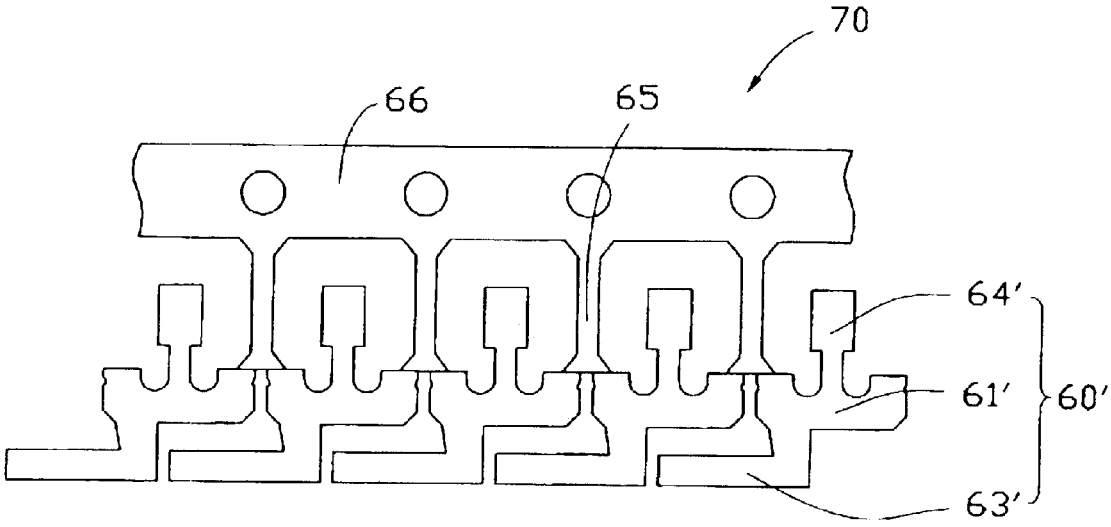
FIG. 10 (PRIOR ART)
FIG. 10 is a top elevation view of part of a contact strip, the contact strip comprising a plurality of precursors of a plurality of the contacts of FIG. 9.

FIG. 5 shows an elongate contact strip 16 used for inserting the contacts 1 into the passages 20 of the housing 2. The contact strip 16 comprises an elongate carrier strip 160, a plurality of linking portions 162 extending from a longitudinal side of the carrier strip 16, and a plurality of strip contacts 1' each attaching to the carrier strip 16 by two adjacent linking portions 162. A plurality of index holes 164 is defined in the carrier strip 160, for facilitating carriage of the contact strip 16. Each strip contact 1' comprises a retention portion 10', a connecting portion 14' coplanarly extending from a rear of the retention portion 10', and a cantilever 12' coplanarly extending from a front of the retention portion 10'.

A pair of shoulders 104 is formed on opposite ends of the rear of each retention portion 10' of each strip contact 1'. Two adjacent shoulders 104 of two adjacent strip contacts 1' are attached to a front end of the corresponding linking portion 162. A pair of barbs 100' is formed at each of opposite lateral edges of the retention portion 10' of each strip contact 1'.

The cantilever 12' of each strip contact 1' comprises a first extending portion 121', and a second extending portion 120' coplanarly extending from a front end of the first extending portion 121'. A rib 124' is formed on the first extending portion 121'. The retention portion 10' and the first extending portion 120' have a common centerline that is perpendicular to a longitudinal axis of the carrier strip 160. The second extending portion 120' is oriented at an acute angle "b" relative to the longitudinal axis of the carrier strip 160. With this configuration, gaps between adjacent contacts 1' are small. Thus the contact strip 16 can be formed from sheet metal with minimal wastage of material, thereby reducing production costs.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical contact for electrically interconnecting two electrical interfaces, the electrical contact comprising:

a retention portion;

a connecting portion extending from an end of the retention portion for engaging one of the electrical interfaces; and a cantilever comprising a first extending portion extending from an opposite end of the retention portion and a second extending portion bent from an end of the first extending portion, the second extending portion comprising an engaging portion for engaging the other electrical interface;

wherein from a top view of the contact, the second extending portion extends at an acute anfle relateve to the retention portion, and a junction line defined between the first and second extending portions is substantially parallel to the retention portion.

2. The electrical contact of claim 1, wherein the second extending portion further comprises a bent portion adjoining said end of the first extending portion, and the engaging portion adjoins at an end of the bent portion.

3. The electrical contact of claim 2, wherein the second extending portion further comprises a locating portion extending down from the engaging portion.

4. The electrical contact of claim 3, wherein the first extending portion forms a rib thereon.

5. The electrical contact of claim 4, wherein the retention portion forms a plurality of barbs on opposite sides thereof.

6. The electrical contact of claim 5, wherein the connecting portion is bent substantially perpendicularly from said end of the retention portion.

7. An electrical connector comprising:

an insulative housing;

columns and rows of passageways formed in the housing, each of said passageways forming a cross-section defining thereof first and second directions mutually perpendicular to each other; and a plurality of contacts respectively disposed in the corresponding passageways, each of said contacts including a retention portion parallel to one of said first and second directions, and a lateral and upward extension portion extending from a vertical portion of each of said contacts and located above said retention portion and including an engaging portion extending above a top face of the housing for mechanically and electrically connecting to a conductive pad of an electronic component seated upon the housing; wherein from a top view of said housing, the extending portion extends from said retention portion in an oblique direction relative to both said first and second directions.

8. The connector of claim 7, wherein a junction line linking the extension portion to said vertical portion of the contacts around an abutment wall in the corresponding passageway, extends horizontally, and wherein said retention portion essentially abuts against said abutment wall.

9. The connector of claim 7, wherein said vertical portion is coplanar with said retention portion.

10. The connector of claim 7, wherein from a top view of said housing, the lateral extension portion extends obliquely from said retention portion relative to an abutment wall, against which the retention portion abuts, at an acute angle.

11. The connector of claim 7, wherein said contacts are made from a planar contact strip, and said extension portion has a part thereof oblique to a carrier of said contact strip at an acute angle.

12. The connector of claim 7, wherein from a top view of said housing, the lateral extension portion extends obliquely from said retention portion relative to an abutment wall, against which the retention portion abuts, at a first acute angle, and wherein said contacts are made from a planar contact strip, and said extension portion has a part thereof oblique to a carrier of said contact strip at a second acute angle substantially equal to said first acute angle.

13. The connector of claim 7, wherein said housing defines a rectangular configuration with periphery edges thereof parallel to said first and second directions, respectively.

* * * * *